US005454239A

United States Patent [19]

Esaki et al.

[11] Patent Number: 5,454,239

[45] Date of Patent: Oct. 3, 1995

[54] DOOR LOCKING HANDLE ASSEMBLY OF PULL-OUT AND SIDE-SWINGING LEVER-ACTION TYPE

[75] Inventors: Takanobu Esaki; Kenichi Yamada, both of Tokyo, Japan

[73] Assignee: Takigen Manufacturing Co. Ltd., Tokyo, Japan

[21] Appl. No.: 191,812

[22] Filed: Feb. 3, 1994

[30] Foreign Application Priority Data

Mar. 5, 1993 [JP] Japan ..... 5-070923

[51] Int. Cl.[6] ..... E05B 13/10

[52] U.S. Cl. ..... 70/208; 70/210; 70/215; 70/224; 292/202; 292/DIG. 31

[58] Field of Search ..... 70/208, 210, 215, 70/224, 467, 469, 489, 201, 205, 192–197, 462, 466, DIG. 31, DIG. 33; 292/202, DIG. 31, DIG. 72, 244, 336.3

[56] References Cited

U.S. PATENT DOCUMENTS

| | | | |
|---|---|---|---|
| 3,576,118 | 4/1971 | Doerrfeld | 292/153 X |
| 4,510,779 | 4/1985 | Ahad | 70/92 X |
| 4,693,503 | 9/1987 | Bisbing | 292/210 |
| 5,201,557 | 4/1993 | Schlack | 292/188 X |
| 5,267,762 | 12/1993 | Gromotka | 292/113 X |
| 5,321,962 | 6/1994 | Ferchau et al. | 70/58 X |
| 5,347,834 | 9/1994 | Ramsauer | 70/120 |

FOREIGN PATENT DOCUMENTS

| | | |
|---|---|---|
| 198764 | 12/1988 | Japan . |
| 66369 | 6/1991 | Japan . |

*Primary Examiner*—Lloyd A. Gall
*Attorney, Agent, or Firm*—Martin Smolowitz

[57] ABSTRACT

A door locking handle assembly of a pull-out and side-swinging lever-action type, includes a casing (4) having a locking shaft (12) pivotally attached to a handle (19), which can be pushed into a casing (4), and locked in its retracted position without fail. A push button (27) is pivoted to a front-end portion of the handle (19) through a pivot (25) passing through an axial hole (50) of the button (27). The hole (50) is obliquely extended and assumes an oval shape. By depressing the pivoted push button (27), the handle (19) swings out of a front concave portion (6) of the casing (4). A catch plate (11) attached to the locking shaft (12) is swingably moved to its unlocking position by side-swinging the handle (19), which has its front-end portion receive a lock unit (31) fixedly in an embedding manner. A lock plate (33), which is interlocked with a rotor (32) of the lock unit (31) so as to move back and forth, is brought into contact with a leg portion (28) of the push button (27) to prevent the push button (27) from rotating inwardly.

4 Claims, 5 Drawing Sheets

DOOR LOCKING HANDLE ASSEMBLY OF PULL-OUT AND SIDE-SWINGING LEVER-ACTION TYPE

BACKGROUND OF THE INVENTION

1. Field of the Invention

The present invention relates to a door locking handle assembly of a pull-out and side-swinging lever-action type. The door locking handle assembly is used in a plugboard box and the like. In operation, the retractable handle of the assembly is pulled out of its casing and side-swung through a predetermined angle to permit a catch plate of the assembly to be free from a receiving portion of a stationary frame element.

2. Description of the Prior Art

In a conventional door locking handle assembly of a pull-out and side swinging lever-action type disclosed in Japanese Utility Model Laid-Open No. Hei 3-66369: a cylinder portion is provided in a base-end portion of a casing fixedly mounted on a door; a locking shaft is inserted in the cylindrical portion and rotatably mounted therein but not axially slidable therein; a catch plate is fixedly mounted on a rear-end portion of the locking shaft; a retractable handle folds into a front concave portion of the casing, and has its base-end portion pivoted to a front-end portion of the locking shaft through a first cross pivot; a biasing spring for swingably biasing the retractable handle in its projecting direction on the first cross pivot, the biasing spring being mounted between the locking shaft and the handle; a push button has its leg portion projected from its rear surface, and is provided with a locking hole and an engaging-hook portion in a front-end portion of the leg portion, the push button being connected with a front-end portion of the handle through a second cross pivot; a position-keeping spring disposed between the handle and the push button, and forces the push button to align with the handle along an extension line thereof; a lock unit is fixedly embedded in a lock-receiving portion provided in a front-end portion of the casing; and, a latch element is so arranged as to be interlocked with a rotor of the lock unit, and is biased forward towards the leg portion of the push button by a return spring to have a front-end portion of the latch element engaged with the locking hole so that the handle is locked up in its retracted position.

However, in the conventional door locking handle assembly described above, there is a fear that the handle is not locked up in its retracted position when the handle is not completely pushed into the casing, because the push button (which is swingably mounted on the front-end portion of the handle through the second cross pivot) tends to excessively swing away from the latch element so that the locking hole of the push button does not engage with the front-end portion of the latch element, which permits the handle to swing back on the first cross pivot in the handle's projecting direction under the influence of the resilient force exerted by the biasing spring.

Further, in another conventional door locking handle assembly of a pull-out and side swinging lever-action type disclosed in Japanese Utility Model Laid-Open No. Sho 63-198764: a cylinder portion is provided in a base-end portion of a casing fixedly mounted on a door; a locking shaft is inserted in the cylindrical portion and rotatably mounted therein but not axially slidable therein; a catch plate is fixedly mounted on a rear-end portion of the locking shaft; a retractable handle folds into a front concave portion of the casing, and has its base-end portion pivoted to a front-end portion of the locking shaft through a first cross pivot; a biasing spring for swingably biasing the retractable handle in its projecting direction on the first cross pivot, the biasing spring being mounted between the locking shaft and the handle; a locking hole is provided in a finger-engaging projection portion of a front-end portion's rear surface of the handle; a lock unit is fixedly embedded in a lock-receiving portion provided in a front-end portion of the casing; and, a latch element is so arranged as to be interlocked with a rotor of the lock unit, and is biased forward towards the finger-engaging projection portion by a return spring to have a front-end portion of the latch element engaged with the locking hole so that the handle is locked up in its retracted position.

However, in the conventional door locking handle assembly described above, there is a fear that the front-end portion of the handle hits the user's fingers. Namely, when the user inserts a key into the lock unit to move its rotor in an unlocking direction thereof, the latch element slidably moves backward to be free from the locking hole of the handle side, so that the handle is immediately projected forward in a swinging manner under the influence of a resilient force exerted by a biasing spring, whereby the front-end portion of the handle hits the user's fingers. In order to prevent the handle from hitting the user's fingers, it is sufficient to dispose the lock unit in a position far away from the front-end portion of the handle. However, naturally, this causes the entire length of the casing to increase. In order to set a sufficient interval between the lock unit and the handle without increasing the entire length of the casing, it is sufficient to decrease the handle in length. However, when a grip portion of the handle is extremely shortened, the handle is impaired in operability. Consequently, such shortening of the grip portion of the handle is not an adequate solution.

SUMMARY OF THE INVENTION

It is an object of the present invention to provide a door locking flush handle assembly of a pull-out and side-swinging lever-action type, in which: a handle is pushed into and pulled out of a front concave portion of a casing without fail; and, a push button is depressed in an easy manner.

It is another object of the present invention to provide a door locking flush handle assembly of a pull-out and side-swinging lever-action type, in which: a grip portion of the handle has a sufficient effective length while the entire length of the casing is minimized.

The above objects of the present invention are accomplished by providing:

- a door locking handle assembly of a pull-out and side-swinging lever action type, comprising:
  - a casing for fixedly mounting on a door;
  - a locking shaft rotatably mounted in a cylindrical portion of a base-end portion of the casing in an insertion manner, said locking shaft being non-axially slidable in the cylindrical portion and having its rear-end portion fixed to a catch plate;
  - a retractable handle which folds into a front concave portion of the casing, and has its base-end portion pivoted to a front-end portion of the locking shaft through a first cross pivot;
  - a biasing spring for swingably biasing the handle in its projecting direction on the first cross pivot, the biasing spring being mounted between the locking shaft and the handle;

a push button which is connected with a front-end portion of the handle through a second cross pivot and is provided with a leg portion projecting from its rear surface, the leg portion having its front-end portion formed into an engaging-hook portion;

a position-keeping spring disposed between the handle and the push button to align the push button with the handle along an extension line of the handle;

a lock unit which is fixedly embedded in a lock-receiving portion of a front-end portion of the handle, and comprises a rotor which is rotatably by a key to move a lock plate forward and backward so that the lock plate is brought into contact with the leg portion of the push button to prevent the push button from rotating downwardly when pressed;

a socket-member spring having its front-end bent portion engaged with an engaging-hook portion of the leg portion, so that the handle is held in the thus depressed position; and a leaf spring having its front-end bent portion engaged with the engaging-hook portion of the leg portion when the push button is depressed to swing on the second cross pivot, so that the push button is held in the thus depressed position, the leaf spring being fixedly disposed in a rear-surface side of the socket-member spring;

wherein the push button is provided with an axial hole which obliquely extends, and assumes an oval shape, and receives therein the second cross pivot through which the push button is pivoted to the handle, so as to permit the lock plate fixed to the rotor of the lock unit to move to its projecting position, whereby the lock plate prevents the push button from rotating about the second cross pivot.

DESCRIPTION OF THE PREFERRED EMBODIMENTS

Figure 1:
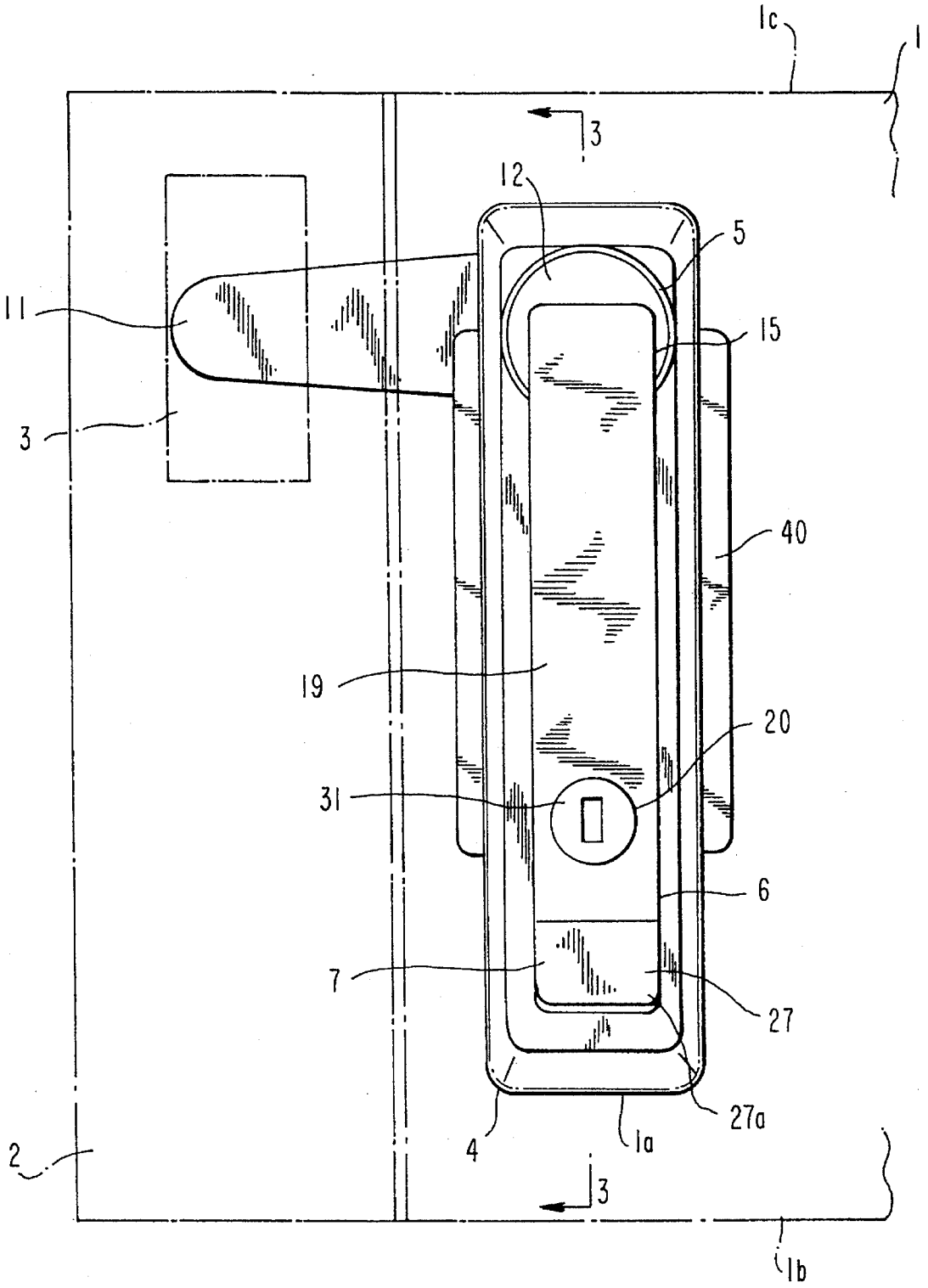
FIG. 1 is a front view of an embodiment of the door locking handle assembly of a pull-out and side-swinging lever-action type of the present invention in a condition in which the handle is retracted.

Hereinbelow, the present invention will be described in detail with reference to the accompanying drawings and the reference numerals and characters.

In a door locking handle assembly of a pull-out and side-swinging lever action type according to the present invention, as shown in FIG. 1, a casing 4 is fixedly mounted on a door 1, and provided with a cylindrical portion 5 in its base-end portion. Rotatably mounted in the cylindrical portion 5 is a locking shaft 12 to a rear-end portion of which a catch plate 11 is fixedly mounted.

A retractable handle 19 folds into a front concave portion 6 of the casing 4 so as to be projectable therefrom. The handle 19 has its base-end portion pivoted to a front-end portion of the locking shaft 12 through a first cross pivot 17. A biasing spring 18 is disposed between the locking shaft 12 and the handle 19, and forces the handle 19 to swing on the cross pivot 17 in a projecting direction for the handle 19.

A push button 27 is provided with an axial hole 50 which obliquely extends, assumes an oval shape and receives therein a second cross pivot 25 through which the push button 27 is pivoted to a front-end portion of the handle 19. Projected from a rear surface of the push button 27 is a leg portion 28 which is provided with an engaging-hook portion 29 in its front-end portion. By means of a position-keeping spring 26 disposed between the handle 19 and the push button 27, the push button 27 is aligned with the handle 19 along an extension line of the handle 19.

Provided in a front-end portion of the handle 19 is a lock-receiving portion 20 in which a lock unit 31 is fixedly embedded. The lock unit 31 comprises a rotor 32 which is rotated by a key 38 to move a lock plate 33 forward and backward, so that the lock plate 33 is brought into contact with the leg portion 28 of the push button 27 when the push button 27 is depressed to swing on the cross pivot 25, whereby the push button 27 is restricted in rotation by the lock plate 33.

A socket-member spring 34 is fixedly mounted on a front-end portion of the front concave portion 6 of the casing 4. The socket-member spring 34 has its front-end bent portion 35 engaged with the engaging-hook portion 29 of the leg portion 28 before the push button 27 is depressed to swing on the cross pivot 25.

Further provided in the present invention is a leaf spring 36 which is fixedly disposed in a position behind the socket-member spring 34. The leaf spring 36 holds the push button 27 in its depressed position when the push button 27 is depressed to swing on the pivot 25 so as to have its engaging-hook portion 29 disengaged with the front-end bent portion 35 of the spring 34.

The oval axial hole 50 is provided in the push button 27 to obliquely extend therein. The second cross pivot 25 passes through the oval hole 50, so that the push button 27 is pivoted to the handle 19 through the second cross pivot 25. The lock plate 33 fixed to the rotor 32 of the lock unit 31 is moved to its projecting position so as to prevent the push button 27 from rotating.

Figure 3:
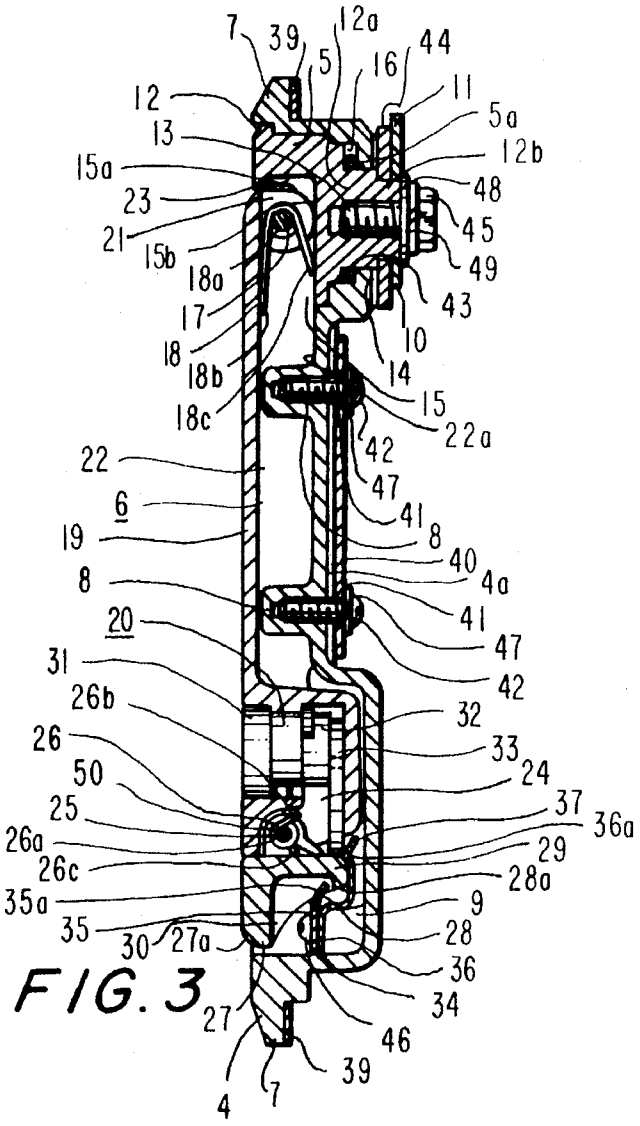
FIG. 3 is a longitudinal sectional view of the door locking assembly of the present invention, taken along the line 3—3 of FIG. 1.
Figure 2:
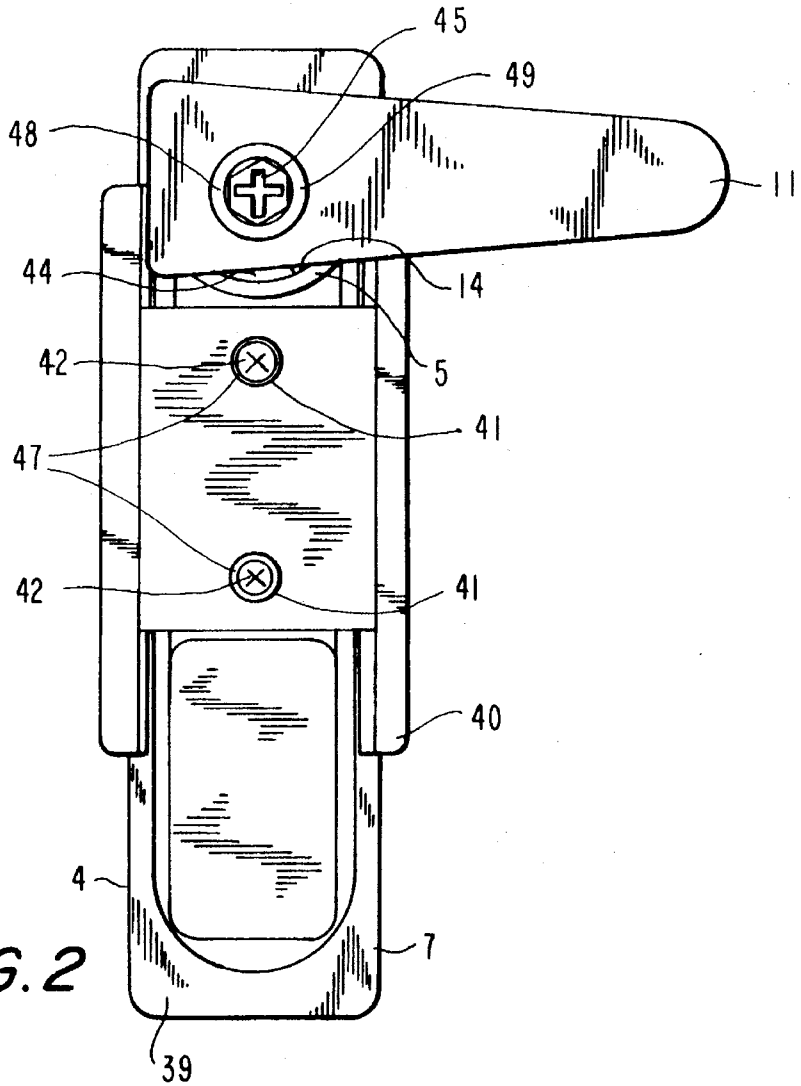
FIG. 2 is a rear view of the door locking assembly of the present invention shown in FIG. 1.

As shown in FIG. 3, in case that the handle 19 is held in its retracted position within the front concave portion 6 of the casing 4, the engaging-hook portion 29 of the push button 27 engages with the socket-member spring 34. At this time, the lock plate 33, which is interlocked with the rotor 32 of the lock unit 31, is in its projecting position to keep in contact with a rear-surface portion **28*a* of the leg portion 28 of the push button 27, so that the push button 27 is restricted in rotation on the cross pin 25, whereby the handle 19** is locked up in its retracted position without fail.

Figure 4:
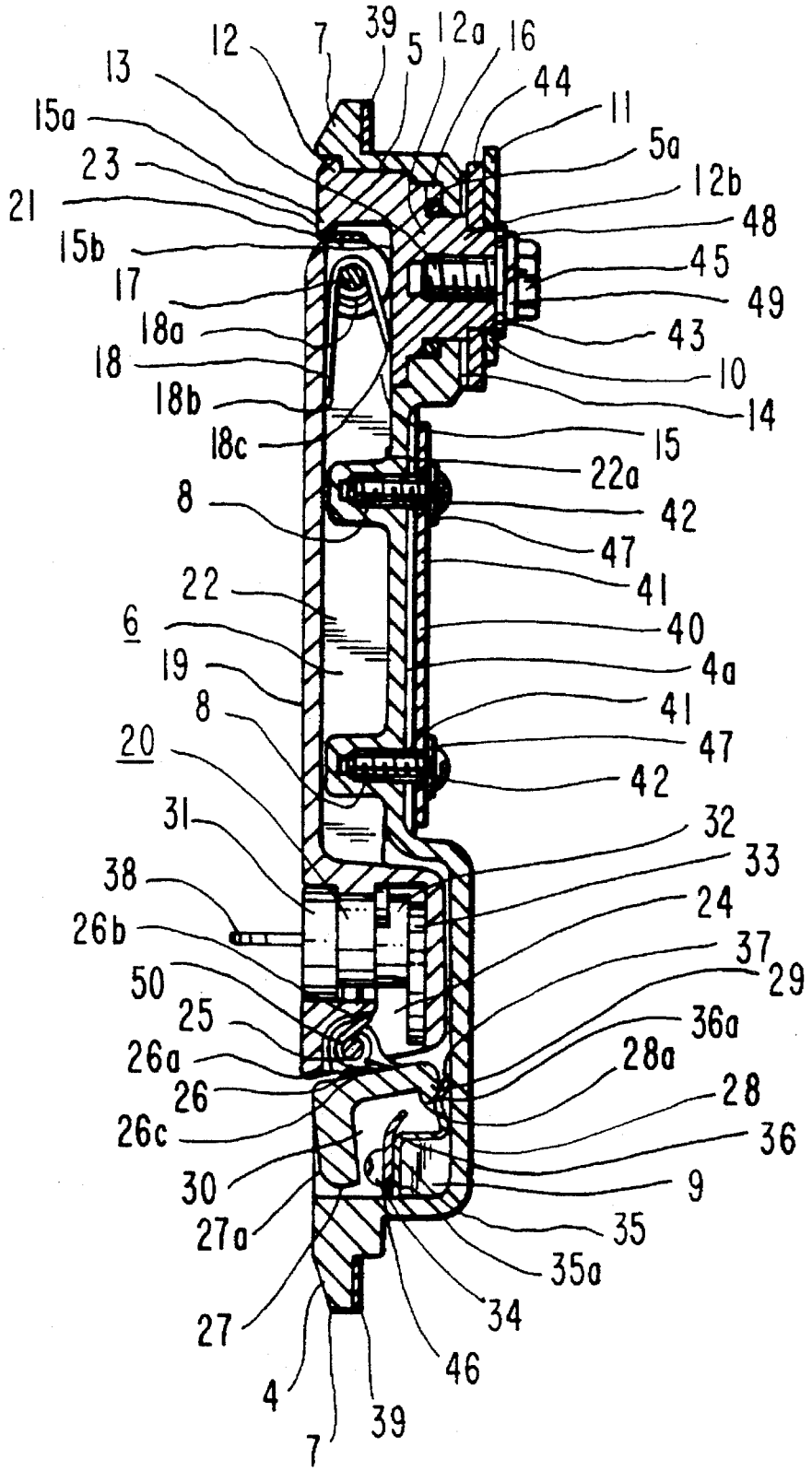
FIG. 4 is a longitudinal sectional view of the door locking assembly of the present invention shown in FIG. 1 in a condition in which the push button is depressed.

As shown in FIG. 4, in order to project the handle 19, the key 38 is inserted in the lock unit 31 to rotate the rotor 32 in its unlocking direction, so that the lock plate 33 interlocked with the rotor 32 is moved backward to release the push button 27 from the restriction on its rotating motion on the cross-pin 25. Under such circumstances, when a front-surface portion 27*a* of the push button 27 is depressed by the user's finger, the push button 27 swings downward on the second cross pivot 25 toward the lock unit 31 against a resilient force exerted by the position-keeping spring 26, so that the engaging-hook portion 29 of the leg portion 28 is disengaged from the bent portion 35 of socket-member spring 34. At this stage, the engaging-hook portion 29 of the leg portion 28 of the push button 27 contacts and is engaged with the front-end bent portion 37 of the leaf spring 36. Since the leaf spring 36 is greater in resilient force than the position-keeping spring 26, the push button 27 remains in its depressed position in which the engaging-hook portion 29 is held in its retracted position to be free from the front-end bent portion 35 of the socket-member spring 34.

Figure 7:
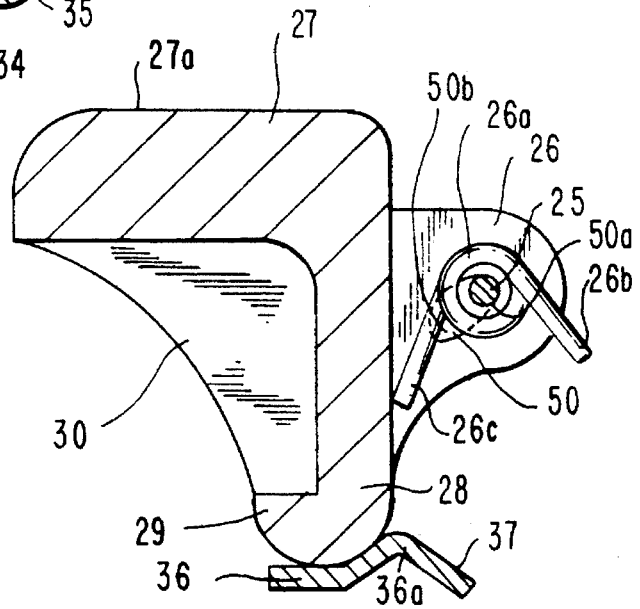
FIG. 7 is a partially enlarged view of the push button, illustrating its pivoted condition.

As shown in FIG. 7, the axial hole 50 of the push button 27 is so provided as to extend obliquely. In a normal condition of push button 27, the second cross pivot 25 is positioned in the top right-hand portion 50*a* of the axial hole 50. When the user depresses the push button 27, the leaf spring 36 resists such user's depressing effort so that the push button 27 slidably moves so that the second cross pin 25 is positioned in the bottom left-hand portion 50*b* of the axial hole 50. This sliding repositioning of push button 27 permits the engaging-hook portion 29 of the push button 27 to clear a projecting portion 36*a* of the leaf spring 36. When the push button 27 is released from such user's depressing effort, it slidably returns to its initial position (i.e., the second cross pivot 25 is located at the top right-hand portion 50*a* of the axial hole 50 of the push button 27).

Figure 5:
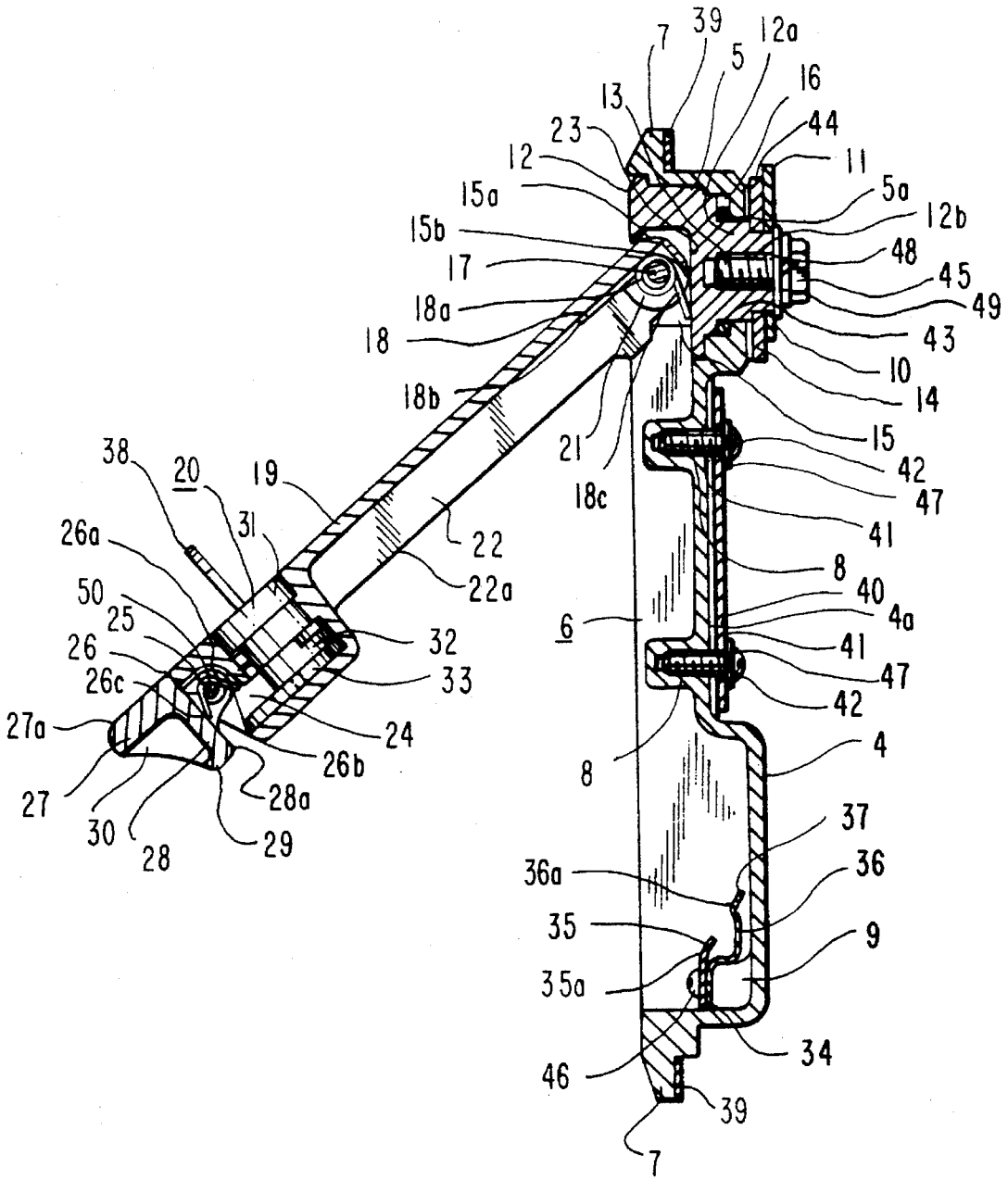
FIG. 5 is a longitudinal sectional view of the door locking assembly of the present invention shown in FIG. 1 in a condition in which the handle is projected.
Figure 6:
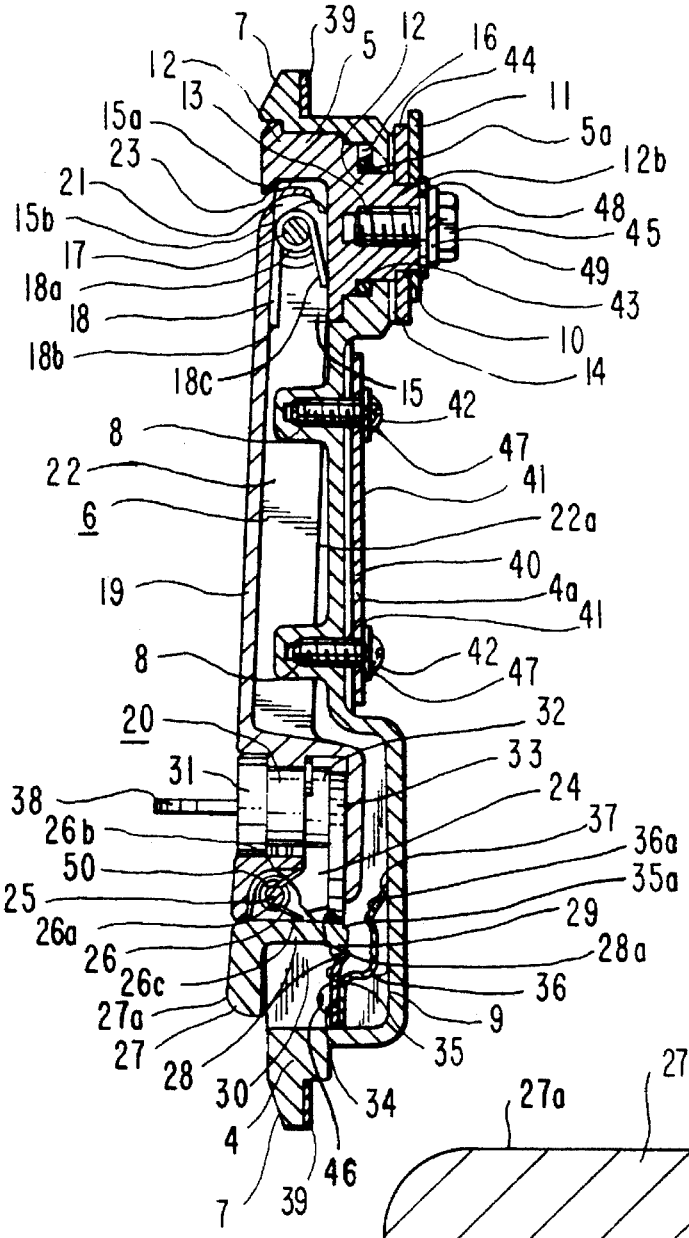
FIG. 6 is a longitudinal sectional view of the door locking assembly of the present invention shown in FIG. 1 in a condition in which the handle is being pushed into the front concave portion of the casing.

When the user's finger moves away from the front-surface portion 27*a* of the push button 27 so that the push button 27 is free from a depressing force exerted by the user's finger, since the handle biasing spring 18 is greater in resilient force than the leaf spring 36, the handle 19 immediately swings outwardly on the first cross pivot 17 to project from the front concave portion 6 of the casing, so that the handle 19 assumes its projecting position as shown in FIG. 5. When the handle 19 is projected, the push button 27 is rotated to its initial position under the influence of the resilient force exerted by the position-keeping spring 26, so that the push button 27 is aligned with the handle 19 along the extension line of the handle 19.

When the thus projected handle 19 is side-swung in a predetermined direction, the locking shaft 12 (which is connected with the handle 19 through the first cross pivot 17 and rotatably supported by the cylindrical portion 5 of the casing 4) is rotated together with the handle 19, so that the catch plate 11 is disengaged from the receiving portion 3 of the stationary frame element 2. As a result, it is possible to open the door 1 (which is unlocked from the stationary frame element 2) by pulling the handle 19 forward. In such door opening operation, the leg portion 28 of the push button 27 (which is connected with the front-end portion of the handle 19) serves as an appropriate finger-engaging portion.

After the door 1 is closed and the handle 19 is reversely swung to have the catch plate 11 engaged again with the receiving portion 3 of the stationary frame element 2, the handle 19 is pushed into the front concave portion 6 of the casing 4. In the last stage of such pushing operation of the handle 19, the engaging-hook portion 29 of the push button 27 abuts against an upper surface 35*a* of the front-end bent portion 35 of the socket-member spring 34, and then resiliently deforms the front-end bent portion 35 of the socket-member spring 34 so as to be engaged with the front-end portion of the socket-member spring 34. As described above, after the handle 19 is pushed in a locking direction and lock plate 33 (which is interlocked with the rotor 32) moves to its projecting position, the lock plate 33 abuts against the rear-surface portion 28*a* of the leg portion 28 of the push button 27. As a result, the push button 27 is prevented from rotating so that the handle 19 is held in its retracted position in the front concave portion 6 of the casing 4 without fail. Then, the key 38 is pulled out of the lock unit 31 to complete a series of locking and unlocking operations of the door 1.

In the embodiment of the present invention shown in the drawings, the elongated casing 4 is inserted into an elongated opening 1*a* of the door 1 from its front surface (1*b*) side to have its outer peripheral flange portion 7 abut on the front surface 1*b* of the door 1. A watertight packing 39 is fitted in a clearance between the outer peripheral flange portion 7 and the front surface 1*b* of the door 1. Then, a mounting plate 40, which is disposed in an intermediate portion of the casing 4 to cover the same portion, is abutted against a rear surface 1*c* of the door 1, and fixedly mounted on the door 1 through round-head screws 42 each of which passes through a through-hole 41 of the mounting plate 40 and is threadably connected with a blind hole 8 of a rear surface wall 4*a* of the intermediate portion of the casing 4.

A watertight O-ring 43 is fitted in an annular groove 16 of the intermediate portion of the locking shaft 12 which has its small-diameter portion 12*a* fitted in a shaft hole 10 of a rear-surface wall portion 5*a* of the cylindrical portion 5 of the casing 4. The small-diameter portion 12*a* of the locking shaft 12 is followed by a square-column portion 12*b* on which both a swing-angle limiting plate 44 and the catch plate 11 are mounted in an insertion manner. Then a bolt 45 is threadably connected with a threaded hole 13 of the square-column portion 12*b* to have these plates 44, 11 fixed to the square-column portion 12*b*, so that the locking shaft 12 is rotatably mounted in the cylindrical portion 5 of the casing 4 but not axially slidable therein. The rear-surface wall portion 5*a* of the cylindrical portion 5 of the casing 4 is provided with a swing-angle limiting projection 14 cooperating with the swing-angle limiting plate 44.

A pair of ribs 22 are provided in opposite side surfaces of the handle 19. Inside the opposite side ribs 22 in the base-end portion of the handle 19, there is provided a cylindrical portion 21 assuming a semispherical shape in its side view. Inserted in an elongated recess provided in a front-end portion of the locking shaft 12 is the base-end portion of the handle 19, so that the cylindrical portion 21 of the handle 19 is guided by the recess 15 of the locking shaft 12, whereby the handle 19 swings on the first cross pivot 17 relative to the locking shaft 12. At this time, the handle 19 is obliquely projected forward while supported by the recess 15, and is side-swung together with the locking shaft 12.

A side-surface portion 15*a* of an inner surface of the recess 15 abuts on an oblique surface 23 provided in the ribs 22 of the base-end portion of the handle 19 to determine a projecting angle of the handle 19 relative to the casing 4. On the other hand, a bottom-surface portion 22*a* of each of the ribs 22 abuts on a bottom-surface portion 15*b* of the recess 15 to determine the retracted position of the handle 19. The biasing spring 18 is constructed of a coil spring which has: its coiled portion mounted on the first cross pivot 17 in an insertion manner; one 18*c* of its opposite linear portions 18*b*, 18*c* abutted against the bottom-surface portion 15*b* of the recess 15 of the locking shaft 12; and, the remaining one 18*b* of its opposite liner portions 18*b*, 18*c* abutted against the rear-surface portion of the handle 19.

The position-keeping spring 26 is constructed of a coil spring. The spring 26 has: its coiled portion 26*a* mounted on the second cross pivot 25 in an insertion manner; one 26*b* of its linear portions 26*b*, 26*c* abuts against a notched edge portion 24 of a rear surface of the handle 19; and the remaining one 26*c* of its linear portions 26*b*, 26*c* abuts against a side surface 28*a* of the leg portion 28 of the push button 27. A reinforcing rib 30 is provided in the leg portion 28 of the push button 27.

In the embodiment of the present invention, a disk-tumbler locking mechanism is used as a lock mechanism for locking the rotor 32 of the lock unit 31 to the main body of the unit. However, it is also possible to use any other suitable lock mechanisms such as radial-pin tumbler locking mechanisms, axial-pin tumbler mechanisms and the like.

The leaf spring 36 is adjacent to the rear surface of the socket-member spring 34. Both the springs 36, 34 have their base-end portions penetrated by a round-head screw 46 which is threadably connected with a projection 9 of a front end of the front concave portion 6 of the casing 4 to have these springs 36, 34 fixed to the casing 4. The leaf spring 36 is greater in resilient force than the position-keeping spring 26, while the handle biasing spring 18 is greater in force than the leaf spring 36.

As described above, in the door locking handle assembly of the pull-out and side-swinging lever-action type of the present invention: the push button 27 is connected with the front-end portion of the handle 19 through the second cross pivot 25; the position-keeping spring 26 is disposed between the handle 19 and the push button 27 to have the push button 27 aligned with the handle 19 along the extension line of the handle 19; the lock unit 31 is fixedly embedded in the lock-receiving portion 20 of the front-end portion of the handle 19; the lock plate 33, which is interlocked with the rotor 32 moves forward and backward as the rotor rotates, so that the lock plate 33 is moved to its projecting position in which the lock plate 33 contacts with the leg portion 28 of the push button 27 when the push button 27 is pushed to swing on the second cross pivot 25, whereby the push button 27 is restricted in rotating motion; and, in the thus restricted condition of the push button 27, the handle 19 is pushed into the casing 4 to have the engaging-hook portion 29 of the push button 27 engaged with the bent portion 35 of socket-member spring 34 mounted on the front end of the front concave portion 6 of the casing 4, so that the handle 19 is locked up in its retracted position. Consequently, it is possible to smoothly perform the pull-out and push-in operation of the handle 19 relative to the casing 4, and also possible to hold the handle 19 in its retracted position without fail, as required.

Further, even in a condition in which the lock plate 33 prevents the push button 27 from swinging inwardly when the handle 19 is pushed into the casing 4, it is possible for the engaging-hook portion 29 of the push button 27 to engage with the socket-member spring 34 since the socket-member spring 34 is resilient to permit its front end portion 35 to resiliently bend.

In addition, in the present invention, the leaf spring 36 is disposed behind the socket-member spring 34. When the lock plate 33 is moved backward to permit the push button 27 to swing inwardly so that the socket-member spring 34 is disengaged from the engaging-hook portion 29 of the push button 27, the engaging-hook portion 29 engages with the front-end bent portion 37 of the leaf spring 36. Under such circumstances, since the position-keeping spring 26 is smaller in resilient force than the leaf spring 36, the push button 27 is still held in its depressed position so that the engaging-hook portion 29 thereof is held in its retracted position free from the front-end portion of the socket-member spring 34. When the user's finger moves away from the front-surface portion 27*a* of the push button 27 to release the push button 27 from a pressure applied by the user's finger, the handle 19 immediately swings on the first cross pivot 17 outward under the influence of the resilient force exerted by the handle biasing spring 18 so that the handle 19 projects out of the front concave portion 6 of the casing 4, because the biasing spring 18 is greater in resilient force than the leaf spring 36. At this time, since the user's finger has already moved away from the front-surface portion of the handle 19, there is no fear that the user's finger is hit by the leg portion 28 of the push button 27 and by the front-end portion of the handle 19. Further, since the leg portion 28 of the push button 27 may effectively serve as a finger-engaging portion, it is possible to reduce in length the handle 19 by an amount corresponding to that of the push button 27. As a result, according to the present invention, it is possible to minimize the entire length of the casing 4 while keeping a sufficient length of the grip portion of the handle 19.

Further, in the present invention, since the axial hole 50 of the push button 27 assumes an oval shape, the push button 27 slidably moves along its oval hole 50 when the push button 27 is depressed. Consequently, it is possible to have the engaging-hook portion 29 of the push button 27 clear the projecting portion 36*a* of the leaf spring 36 smoothly with a less depressing effort than that required in the conventional assembly, which makes it possible to easily depress the push button 27 in use.

What is claimed is:

1. A door locking handle assembly of a pull-out and side-swinging lever-action type, comprising:

a casing (4) for fixedly mounting on a door (1);

a locking shaft (12) rotatably mounted in a cylindrical portion (5) of a base-end portion of said casing (4) in an insertion manner, said locking shaft (12) being non-axially slidable in said cylindrical portion (5) and having its rear-end portion fixed to a catch plate (11);

a retractable handle (19) which folds into a front concave portion (6) of said casing (4), and has its base-end portion pivoted to a front-end portion of said locking shaft (12) through a first cross pivot (17);

a biasing spring (18) for swingably biasing said handle (19) in its projecting direction on said first cross pivot (17), said biasing spring (18) being mounted between said locking shaft (12) and said handle (19);

a push button (27) which is connected with a front-end portion of said handle (19) through a second cross pivot (25) and is provided with a leg portion (28) projecting from its rear surface, said leg portion (28) having its front-end portion formed into an engaging-hook portion (29);

a position-keeping spring (26) disposed between said handle (19) and said push button (27) to align said push button (27) with said handle (19) along an extension line of said handle (19);

a lock unit (31) which is fixedly embedded in a lock-receiving portion (20) of a front-end portion of said handle (19), and comprises a rotor (32) which is rotatable by a key (38) to move a lock plate (33) forward and backward so that said lock plate (33) is brought into contact with said leg portion (28) of said push button (27) to prevent said push button (27) from rotating on said second cross pivot (25);

a socket-member spring (34) having a front-end bent portion (35) engaged with the engaging-hook portion (29) of said leg portion (28), so that said handle (19) is held in a thus depressed position; and a leaf spring (36) having a front-end bent portion (37) engaged with said engaging-hook portion (29) of said leg portion (28) when said push button (27) is depressed to swing on said second cross pivot (25), so that said push button (27) is held in the thus depressed position, said leaf spring (36) being fixedly disposed behind a rear-surface side of said socket-member spring (34);

wherein said push button (27) is provided with an axial hole (50) which extends obliquely and assumes an oval shape, and receives therein said second cross pivot (25) through which said push button (27) is pivoted to said handle (19), so as to permit said lock plate (33) fixed to said rotor (32) of said lock unit (31) to move to its projecting position, whereby said lock plate (33) prevents said push button (27) from rotating on said second cross pivot (25).

2. The door locking handle assembly of claim 1, wherein said casing (4) includes a peripheral flange (7) and is inserted into an elongated opening of a door, and a packing element (39) is fitted into a clearance space between said peripheral flange and the door front surface.

3. The door locking handle assembly of claim 2, wherein said casing (4) includes a mounting plate (40) which is abutted against the door rear surface and fixedly attached to the casing (4).

4. The door locking handle assembly of claim 1, wherein said locking shaft (12) includes a smaller-diameter portion (12*a*) fitted into a shaft hole (10) in said cylindrical portion (5) and a square-column portion (12*b*) which is fixedly-attached onto said catch plate (11).

* * * * *